US005380962A

United States Patent [19]

Johannessen

[11] Patent Number: 5,380,962

[45] Date of Patent: Jan. 10, 1995

[54] HIGH-POWER RF SWITCH

[75] Inventor: Paul R. Johannessen, Lexington, Mass.

[73] Assignee: Megapulse, Inc., Bedford, Mass.

[21] Appl. No.: 893,676

[22] Filed: Jun. 5, 1992

[51] Int. Cl.[6] ..... H01H 9/00

[52] U.S. Cl. ..... 200/1 R; 200/18

[58] Field of Search ..... 200/1 R, 16 B, 16 E, 200/17 R, 18, 175, 176, 177

[56] References Cited

U.S. PATENT DOCUMENTS

| | | | |
|---|---|---|---|
| 3,026,396 | 3/1962 | Fisher | 200/170 |
| 3,053,945 | 9/1962 | Harton et al. | 200/16 |
| 4,001,598 | 1/1977 | Johannessen | 307/106 |
| 4,685,019 | 8/1987 | Needham | 361/2 |
| 5,207,318 | 5/1993 | Roland et al. | 200/534 |

*Primary Examiner*—A. D. Pellinen

*Assistant Examiner*—Michael A. Friedhofer

*Attorney, Agent, or Firm*—Rines & Rines

[57] ABSTRACT

The invention relates to a novel high-speed actuated high-voltage RF switch for such purposes as the cold switching of short very high current RF pulses in applications such as solid-state Loran-C transmitters and the like, as for switching between coupling/output networks thereof. The switch comprises planar upper and lower unconnected pairs of longitudinally extending input and output bus strips electrically connectable by the transverse insertion of planar link strips slightly separated therefrom and the rapid compression thereof against the adjacent end portions of the unconnected input and output bus strips, enabling rapid switching absent wear of the contact surfaces, but with the provision of adequate spacing for high voltage operation and adequate contact pressure to eliminate current arcing.

11 Claims, 4 Drawing Sheets

HIGH-POWER RF SWITCH

The present invention relates to apparatus for switching between high power radio-frequency (RF) networks, being more particularly concerned with the problems of current arcing and switch contact wear.

BACKGROUND OF THE INVENTION

One of the important applications of the present invention resides in the cold switching of short, very high current RF pulses, particularly applicable to solid state Loran-C transmitters and the like. Such transmitters, in preferred form, consist of a number (8–64) of half-cycle generators connected in parallel as described, for example, in U.S. Pat. No. 4,001,598 of common assignee. The output of these generators is connected to a coupling-/output network. To obtain high reliability, the coupling/output network is redundant, and the switching from one coupling/output network to the other is to be performed by the high-power switch of this invention—this being appropriate when a generator module has failed, or otherwise is to be bypassed.

To prevent current arcing, high contact pressure over the full contact surface area is required. In the past, however, this contact pressure has been obtained by spring loading the mating contact surfaces. This spring loading has resulted in high contact insertion forces, and excess contact wear has had to be tolerated. When the switch is in the open position, indeed, a large airgap is required to withstand the high open switch voltage. The combination of long contact travel and high insertion force has, therefore, in the past, resulted in not only excessive contact wear but also a relatively slow-operating switch.

By eliminating contact spring loading and using a novel link/bus compression construction, the switch of this invention has been found remarkably to eliminate both of these problems and, in addition, to provide superior electrical surface contact and to enable far more rapid switching than has heretofore been attainable in these applications.

OBJECTS OF INVENTION

An object of the invention, accordingly, is to provide a new and improved switching apparatus for high current RF pulse circuits and the like that is not subject to any of the contact wear, arcing or inherently relatively slow switching speeds of prior art constructions; but that, to the contrary, enables adequate switch contact pressure to eliminate current arcing with substantially no wear of the contact surfaces and at high speeds of switching.

A further object is to provide such a new and improved high-power RF switch embodying a novel sliding link/bus compression construction.

Other and further objects will be described hereinafter and are more particularly described in connection with the appended claims.

DRAWINGS

The invention will now be described in connection with the accompanying drawings, FIG. 1 of which is an elementary isometric diagram explaining the bus switching underlying the invention;

FIGS. 2*a* and 2*b* are diagrams of link insertion positions;

FIG. 3 is a longitudinal section of the link/bus compression system of the switch of the invention; and FIG. 4 is an isometric view of a practical switch, in preferred form, operating in accordance with the principles of FIGS. 1–3.

SUMMARY

In summary, from one of its viewpoints, the invention embodies a high-voltage RF switch having, in combination, a first pair of longitudinally extending coplanar input and output conductive bus strips, adjacent end portions of which are electrically unconnected; a second pair of similar coplanar unconnected longitudinally extending input and output bus strips disposed vertically spaced below but aligned with the first pair of bus strips to provide upper and lower pairs of bus strips; first and second link strips disposed horizontally laterally to the side of the respective pairs of bus strips and in upper and lower planes slightly spaced from the respective upper and lower surfaces of the upper and lower pairs of bus strips; means for horizontally moving the upper and lower link strips transversely to overlie the adjacent end portions of the respective upper and lower pairs of bus strips; and means for thereupon compressing the link strips against the said upper and lower surfaces of the first and second pairs of bus strips, electrically to connect the same and provide a switch closing.

Preferred and best mode design features will now be described in detail.

DESCRIPTION OF THE PREFERRED EMBODIMENT

Figure 1:
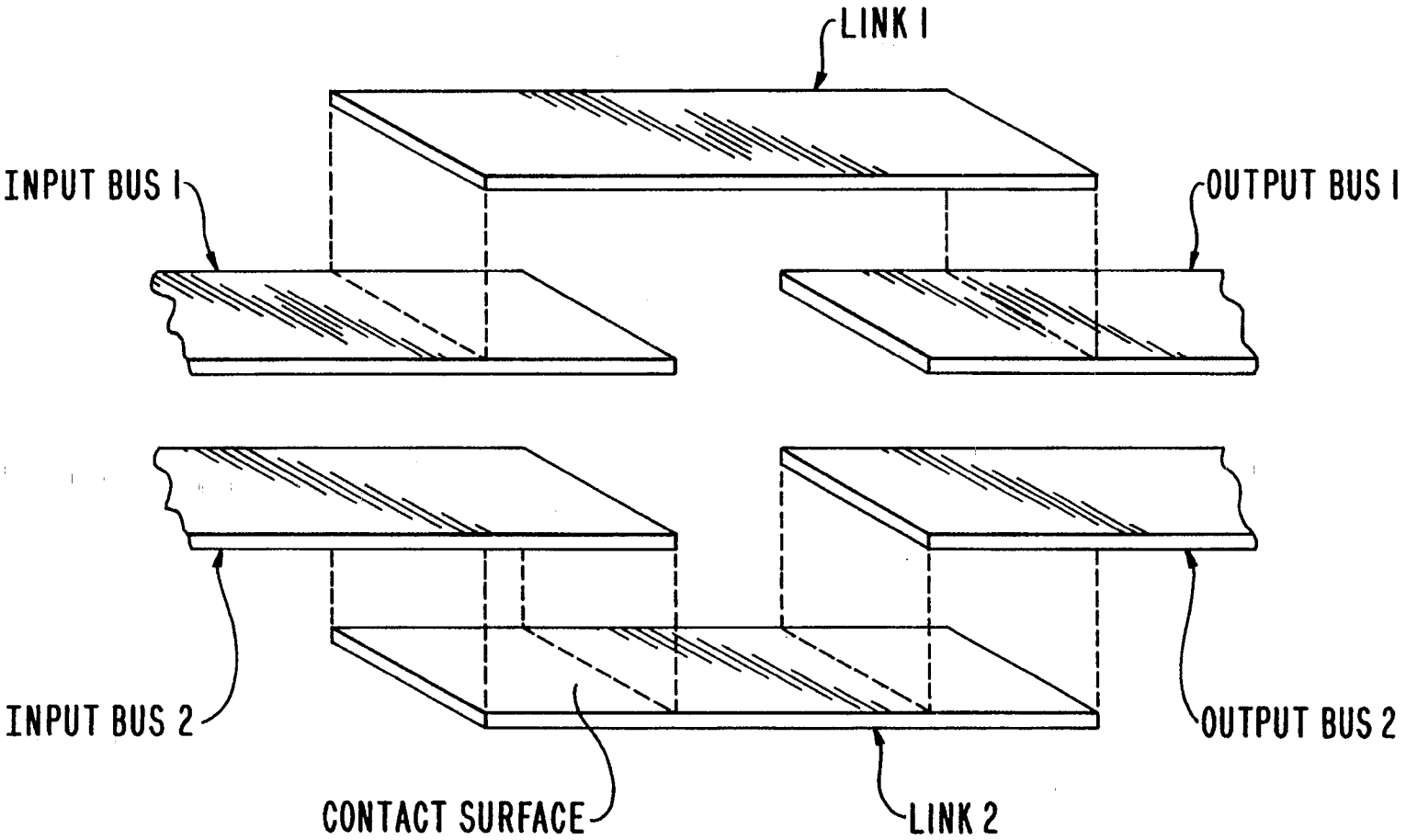

The bus switching problem is illustrated in FIG. 1, wherein there are two vertically spaced incoming planar and parallel conducting flat plate, strip or sheet longitudinally extending buses, referred to as Input Bus #1 and Input Bus #2. The input buses may be connected, for example, to an RF generator output network which it may be desired to switch to corresponding coplanar output buses, referred to as Output Bus #1 and Output Bus #2, respectively. These two input-output pairs of stacked coplanar aligned buses are schematically shown as respectively linkable by means of two flat plate links, labelled Link #1 and Link #2. To close the bus switch, the Links #1 and #2 must be laterally inserted physically to overlie and then connect respective Input and Output Buses #1 and #2, respectively, as illustrated by dotted lines in FIG. 1. High contact pressure, however, is required to prevent current arcing.

Typical dimensions of the buses may be, for example, 3 inches wide and 0.25 inches thick. When the switch is to be in an open position, the spacing between the adjacent end portions of the respective unconnected input and output buses and the spacing between the buses and the open links must then be equal to or greater than about 2 inches in order to be able to withstand the high open switch voltages. To obtain this large spacing, high contact pressure, while enabling fast switching operation, the switching action is divided into two parts: the transverse insertion of the links between the respective longitudinally extending input and output buses to bridge the same, and the vertical compression connection of the links and corresponding buses together.

Figure 2A:
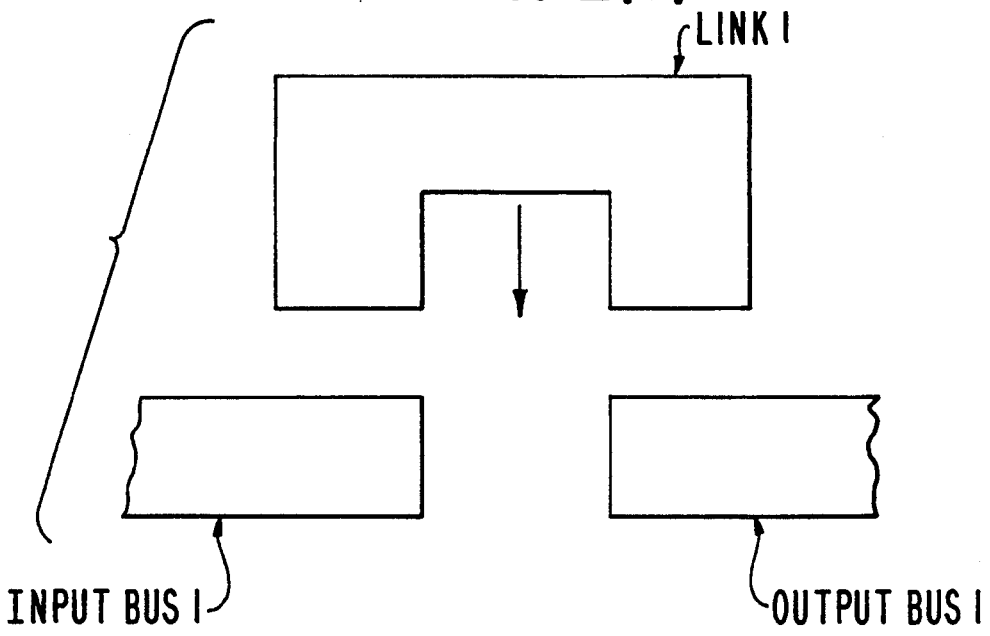
Figure 2B:
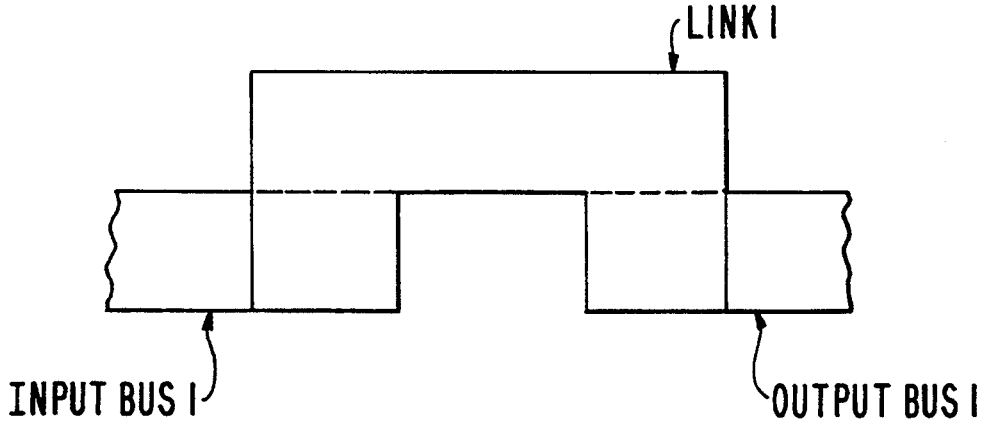

A top view of the link insertion process is schematically shown in FIG. 2. The links (shown exemplarily for Link #1) are inserted from the side, being preferably U-shaped planar strips slightly spaced from the upper (or lower) bus strip surfaces, with the arms and neck of the U allowing for longer creepage paths in the insulating materials used to clamp and separate the buses, as later described in connection with FIG. 3. The switch is shown in the open position in FIG. 2(*a*) with the U-shaped Link #1 separated horizontally to the side of Input and Output Buses #1; and, in the closed position of FIG. 2(*b*), with the flat link surfaces transversely overlying and interconnecting the adjacent end portions of the bus strips.

Figure 3:
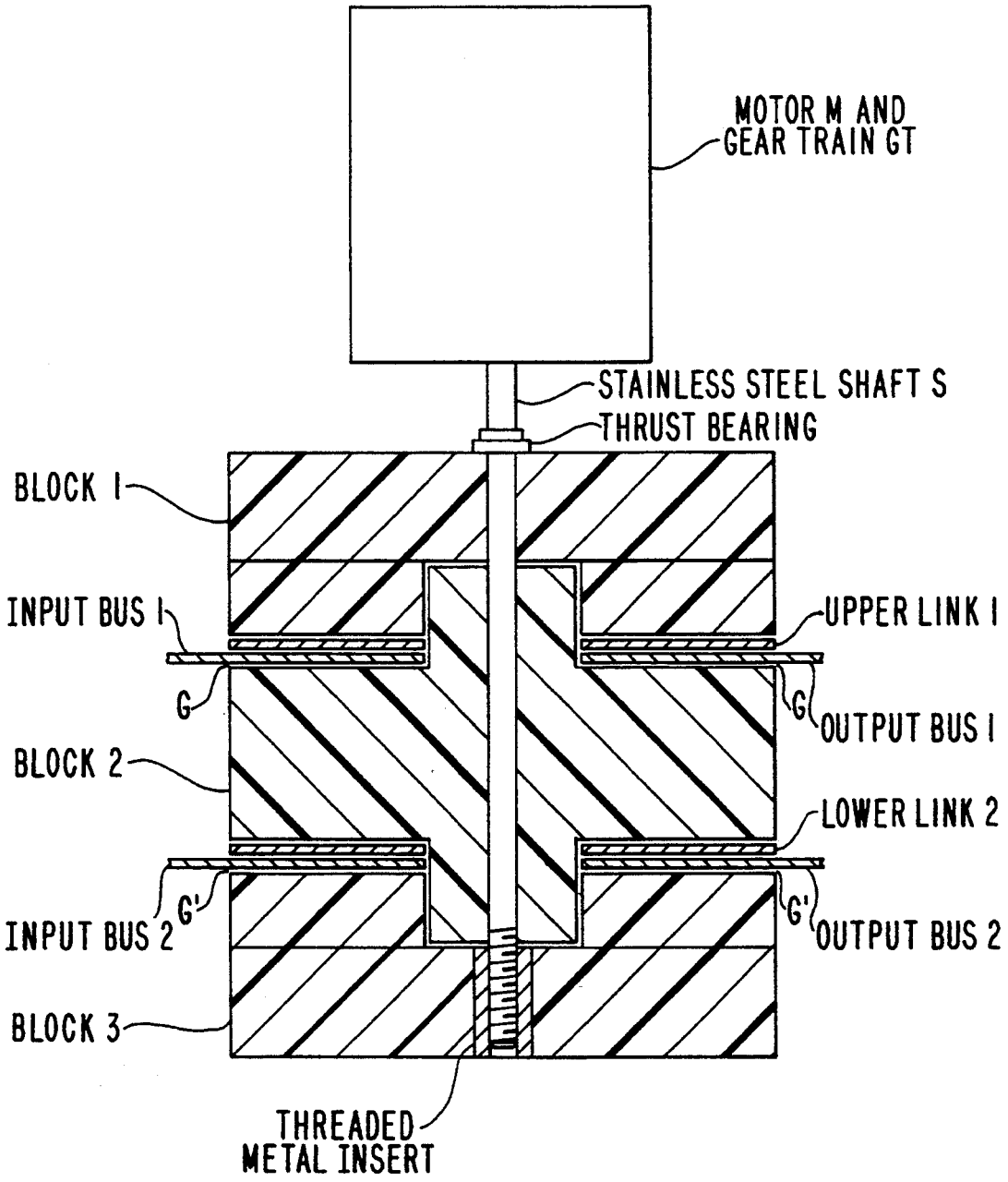

A front view of the switch showing the Link/Bus compression system in the closed position of FIG. 2(*b*) is shown in FIG. 3. This compression system consists of a stack of three blocks of insulating material, Blocks #1, #2 and #3, as of G10 or other suitable plastic or the like. Block #2 provides the mounting spacing between the upper and Lower buses, and contains gaps G and G' for receiving the links; and Blocks #1 and #3 compress together the buses and the inserted links by means of a torque motor M and a threaded stainless steel shaft S.

The electric contact area between two flat surfaces, such as the link and bus sheets or strips, is proportional to the contact pressure (lbs/in$^2$) and inversely proportional to the hardness of the contact material. Due to microscopic irregularities of flat surfaces, however, only a small portion of the contact surface areas are in actual physical contact. For example, for flat silver contacts, only approximately 1% of the surface areas are in contact when the applied contact pressure is 300 lbs/in$^2$. Therefore, to maximize the actual contact pressure, both the planar conducting plate links and buses are made of soft copper and plated with gold or other noble metal in the contact areas.

Figure 4:
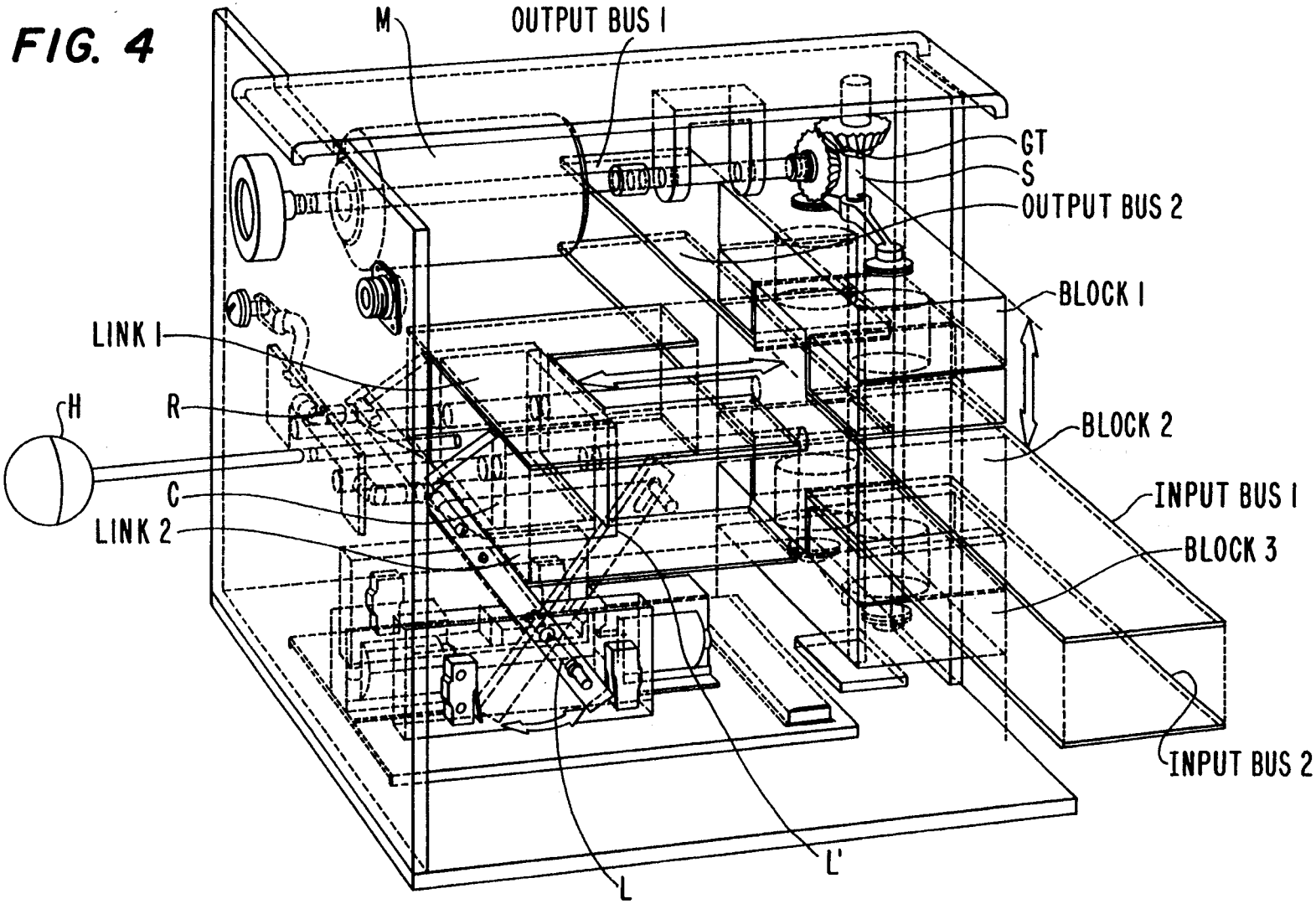

In the isometric view of the switch shown in FIG. 4, the two Links #1 and #2 are mounted on a carriage C that rides on two travel rods R. The carriage C is moved transversely horizontally back and forth by means of two Lateral solenoid-controlled linkage arms L, the dotted position L' showing the forward link-insertion position. The switch is closed by driving the carriage C toward the compression blocks (to the right in FIG. 4, as shown in dotted lines and by the horizontal arrow), thereby inserting the links into the gaps G, G' between the compression blocks #1 and #3 and the block #2 wherein the buses are located, overlying the respective input and output adjacent bus strip end portions. During this operation, the compression blocks are spread apart or separated so that the links can be inserted with no insertion force and consequently no contact wear. Once the links have been inserted into the upper lower gaps G and G' in the compression blocks, the torque motor M is turned on and, through the beveled gear train GT, drives Blocks #1 and #3 vertically together (vertical arrow) and thereby compresses the arms of the Links #1 and #2 to the corresponding buses, electrically to interconnect the respective input and output pairs of buses #1 and #2. When adequate compression force has been obtained, the torque motor M is turned off, and the compression maintained to keep the switch closed.

To open the switch, the torque motor M is again turned on and now rotates the compression shaft S in the opposite direction, thereby separating the compression blocks, which, in turn, releases the pressure on the link arms overlying the end portions of the buses. When separation of the links and buses has been obtained, the torque motor M is turned off. The turn-off of the torque motor is done by suitably located microswitches, not shown, as is well known. The solenoids that operate the link carriage C are now energized and drive the carriage C transversely away from the compression blocks (to the left), thereby placing the switch in the open position again.

The link carriage C can be transversely driven back and forth at a rapid rate since there are no friction forces acting upon it. The torque motor M can compress the links to the buses in a short time interval since the distances to travel for the compression blocks are very short (less than 0.25 inches in the above example). In this way, a switch has been produced that, in practice, can open or close in less than 2 seconds, causes no wear of the contact surfaces, provides adequate spacing for high voltage operation, and provides adequate contact pressure to eliminate current arcing.

An emergency hand-operated plunger H may be provided in the event of failure of the solenoids.

The terms vertical and horizontal, upper and lower, and forward and backward, as used herein, are illustrative since the switch may also be operated in other orientations; and further modifications will occur to those skilled in this art, such being considered to fall within the spirit and scope of the invention as defined in the appended claims.

What is claimed is:

1. A high-voltage RF switch having, in combination, first and second pairs of longitudinally extending planar input and output unconnected conductive bus strips each having aligned adjacent end portions, and with one pair vertically spaced below but aligned with the upper pair of bus strips; upper and lower link strips, one for each pair of bus strips and horizontally spaced from the said aligned adjacent end portions thereof, and of dimensions sufficient to bridge the space between the said adjacent end portions of the pair of bus strips; means for horizontally moving the upper and lower Link strips to extend between the said adjacent end portions of the respective upper and lower pairs of bus strips; and means for thereupon vertically compressing together the end portions of the respective pair of bus strips with the link strip therebetween electrically to connect the same and provide a radio-frequency switch closing.

2. A high-voltage RF switch as claimed in claim 1 and in which the link strips are of U-shape with the arms of the U transversely overlying and compressively contacting the end portions of the bus strips in closed switch position and the neck of the U providing a bridging electrical connection therebetween.

3. A high-voltage RF switch as claimed in claim 1 and in which the bus strips are spaced and carried by an intermediate insulating block, and upper and lower insulating blocks are provided which, upon actuation of the compressing means, compresses the upper and lower blocks against the intermediate block with such pressure as to achieve the desired contact pressure between the link and bus strips.

4. A high-voltage RF switch as claimed in claim 3 and in which the compressing means is operated by a torque motor through a compression shaft extending vertically through the blocks and causing the vertical movement of the upper and lower blocks to compress against the intermediate block and to be separated from such compression.

5. A high-voltage RF switch as claimed in claim 4 and in which the distance of compressive travel of the upper and lower blocks is of the order of 0.25 inches.

6. A high-voltage RF switch as claimed in claim 1 and in which the moving means is provided with means for horizontally transversely withdrawing the link strips from the bus strips upon release of the compressing means and resultant separation of the link and bus strips.

7. A high-voltage RF switch as claimed in claim 6 and in which the upper and lower link strips are mounted upon a carriage provided with solenoid-controlled linkage arms for laterally moving the carriage toward and away from the bus strips.

8. A high-voltage RF switch as claimed in claim 7 and in which the compressing means is operated by a torque motor through a compression shaft causing the vertical movement of the link strips to engage the bus strips and to be separated from such engagement.

9. A high-voltage RF switch as claimed in claim 7 and in which the solenoid linkage and torque motor are actuable in less than about 2 seconds to effect operation of the switch.

10. A high-voltage RF switch as claimed in claim 1 and in which the adjacent end portions of each pair of bus strips, during compression, bear against opposite edges of the corresponding link strip transversely of the strips.

11. A high-voltage RF switch as claimed in claim 1 and in which the input and output bus strips of each pair are co-planar.

* * * * *